US012473057B2

(12) United States Patent
Willis

(10) Patent No.: US 12,473,057 B2
(45) Date of Patent: Nov. 18, 2025

(54) COLLAPSIBLE WATERCRAFT

(71) Applicant: Oru Kayak, Inc., Emeryville, CA (US)

(72) Inventor: Anton Michael Willis, Oakland, CA (US)

(73) Assignee: Oru Kayak, Inc., Emeryville, CA (US)

( * ) Notice: Subject to any disclaimer, the term of this patent is extended or adjusted under 35 U.S.C. 154(b) by 432 days.

(21) Appl. No.: 18/174,867

(22) Filed: Feb. 27, 2023

(65) Prior Publication Data

US 2023/0271678 A1 Aug. 31, 2023

Related U.S. Application Data

(60) Provisional application No. 63/314,298, filed on Feb. 25, 2022.

(51) Int. Cl.
*B63B 34/23* (2020.01)

(52) U.S. Cl.
CPC ..... *B63B 34/23* (2020.02)

(58) Field of Classification Search
CPC ..... B63B 34/23
See application file for complete search history.

(56) References Cited

U.S. PATENT DOCUMENTS

| | | | | |
|---|---|---|---|---|
| 3,121,887 | A * | 2/1964 | Baretta | B63B 7/08 114/354 |
| 5,184,565 | A * | 2/1993 | Matthews | B63B 7/06 D12/300 |
| 8,783,204 | B1 | 7/2014 | Herold | |
| 9,422,029 | B1 * | 8/2016 | Niemier | B63B 34/23 |
| 2018/0127061 | A1 | 5/2018 | Willis | |
| 2018/0127062 | A1 | 5/2018 | Jin et al. | |
| 2019/0389541 | A1 * | 12/2019 | Willis | B63B 34/23 |
| 2020/0361576 | A1 | 11/2020 | Willis et al. | |

FOREIGN PATENT DOCUMENTS

| | | | |
|---|---|---|---|
| CA | 876484 | A | 7/1971 |

* cited by examiner

*Primary Examiner* — Stephen P Avila
(74) *Attorney, Agent, or Firm* — Kolitch Romano Dascenzo Gates LLC

(57) ABSTRACT

A collapsible kayak may include a single-piece hull including a plurality of crease lines along which the hull is foldable. A removable floorboard lines a midship portion of the hull between a bow portion and a stern portion, the floorboard including a seat assembly and configured to be releasably retained by a pair of outboard walls permanently fixed at port and starboard sides of the cockpit. The stern portion of the hull is permanently folded in a V-shaped (AKA swallowtail) configuration to form a closed transom of the kayak. The bow, stern, and midship portions are configured as a tri-fold, such that the bow portion and the stern portion of the kayak are foldable toward each other to overlap the midship portion of the hull when collapsed.

20 Claims, 17 Drawing Sheets

COLLAPSIBLE WATERCRAFT

CROSS-REFERENCES

The following applications and materials are incorporated herein, in their entireties, for all purposes: U.S. Provisional Patent Application Ser. No. 63/314,298, filed Feb. 25, 2022.

FIELD

This disclosure relates to systems and methods for collapsible watercraft. Specifically, this disclosure relates to foldable kayaks.

INTRODUCTION

Kayaks and other lightweight, personal watercraft are popular for recreational use on rivers, lakes, oceans, and other suitable locations. Collapsible watercraft may be especially convenient in at least some cases due to the ease with which they can be transported and stored. For example, a foldable kayak may be folded into a relatively small configuration when not in use on the water. In the folded state, the foldable kayak is less cumbersome to carry than a conventional kayak and requires less space to store. Various aspects of the foldable kayak's design impact the ease of assembling the kayak, the robustness of the assembled kayak, and the suitability of the kayak for different types of use. Types of use may include, for example, kayaking with different numbers of passengers, or during activities requiring use and/or storage of equipment (e.g., photography, fishing, hunting, etc.).

SUMMARY

The present disclosure provides systems, apparatuses, and methods relating to collapsible watercrafts.

In some embodiments, a collapsible kayak may comprise: a continuous sheet forming a hull having a bow portion, a midship portion, and a stern portion, the hull including a plurality of living hinges along which the hull is foldable, at least one of the living hinges of the hull having a fore-and-aft orientation in the midship portion; and a removable floorboard disposed in the midship portion of the hull, the floorboard being configured to fold only at one or more creases oriented in respective athwartships directions.

In some embodiments, a collapsible kayak may comprise: a continuous sheet forming a single-piece hull having a bow portion, a midship portion, and a stern portion, the hull including a plurality of crease lines along which the hull is foldable, at least one of the crease lines of the hull having a longitudinal orientation; and a foldable floorboard disposed in the midship portion of the hull, the floorboard being configured to fold only at one or more creases oriented in respective athwartships directions; wherein the foldable floorboard extends across an entire width of a floor of the hull, such that the foldable floorboard is configured to oppose inward collapsing of the midship portion.

Features, functions, and advantages may be achieved independently in various embodiments of the present disclosure, or may be combined in yet other embodiments, further details of which can be seen with reference to the following description and drawings.

DETAILED DESCRIPTION

Figure 1:
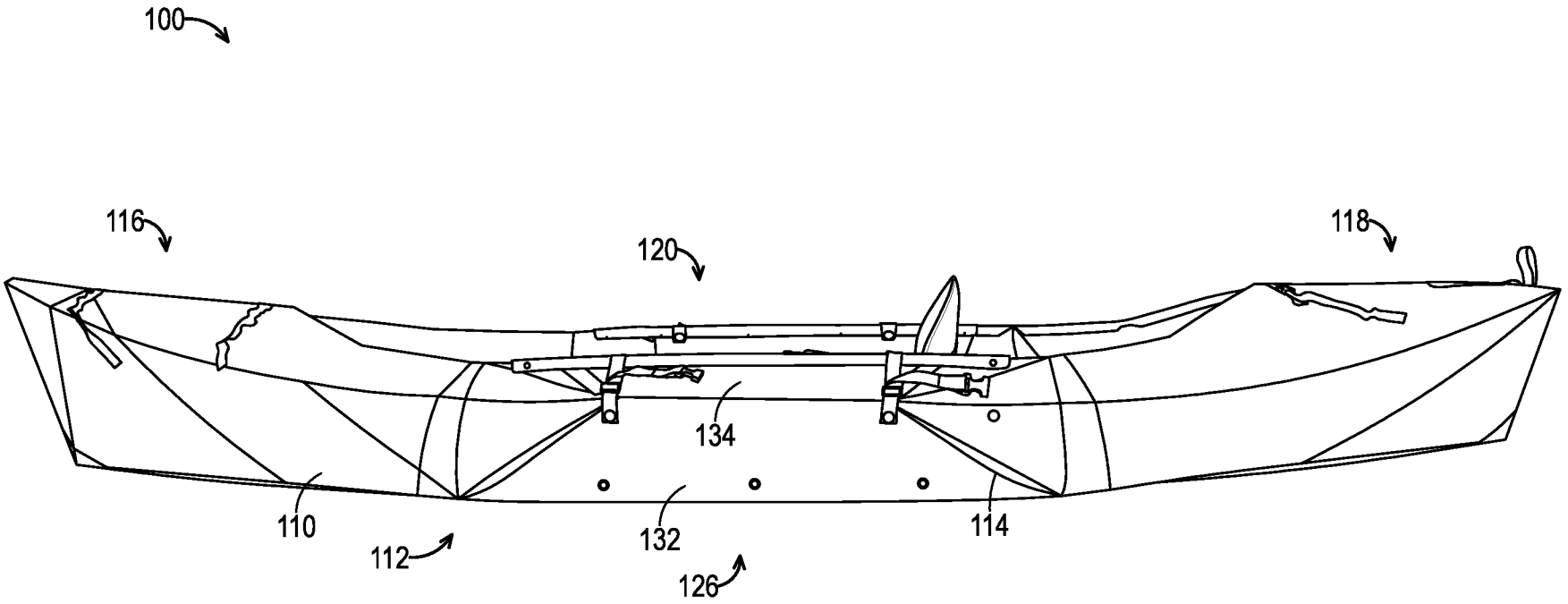
FIG. 1 is a side elevation view of an illustrative collapsible watercraft in a deployed state.

Various aspects and examples of a collapsible watercraft, as well as related methods, are described below and illustrated in the associated drawings. Unless otherwise specified, a watercraft in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections, each of which is labeled accordingly.

Definitions

The following definitions apply herein, unless otherwise indicated.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

"Elongate" or "elongated" refers to an object or aperture that has a length greater than its own width, although the width need not be uniform. For example, an elongate slot may be elliptical or stadium-shaped, and an elongate candlestick may have a height greater than its tapering diameter. As a negative example, a circular aperture would not be considered an elongate aperture.

The terms "inboard," "outboard," "forward," "rearward," and the like are intended to be understood in the context of a watercraft and/or of a host watercraft on which systems described herein may be mounted or otherwise attached. For example, "outboard" may indicate a relative position that is laterally farther from the centerline of the watercraft, or a direction that is away from the watercraft centerline. Conversely, "inboard" may indicate a direction toward the centerline, or a relative position that is closer to the centerline. Similarly, "forward" and "fore" mean toward the front portion of the watercraft (e.g., the bow), and "aft" means toward the rear of the watercraft (e.g., the stern). In the absence of a host watercraft, the same directional terms may be used as if the watercraft were present. For example, even when viewed in isolation, a device may have a "forward" edge, based on the fact that the device would be installed with the edge in question facing in the direction of the bow of the host watercraft.

"Coupled" means connected, either permanently or releasably, whether directly or indirectly through intervening components.

"Resilient" describes a material or structure configured to respond to normal operating loads (e.g., when compressed) by deforming elastically and returning to an original shape or position when unloaded.

"Rigid" describes a material or structure configured to be stiff, non-deformable, or substantially lacking in flexibility under normal operating conditions.

"Elastic" describes a material or structure configured to spontaneously resume its former shape after being stretched or expanded.

"Providing," in the context of a method, may include receiving, obtaining, purchasing, manufacturing, generating, processing, preprocessing, and/or the like, such that the object or material provided is in a state and configuration for other steps to be carried out.

In this disclosure, one or more publications, patents, and/or patent applications may be incorporated by reference. However, such material is only incorporated to the extent that no conflict exists between the incorporated material and the statements and drawings set forth herein. In the event of any such conflict, including any conflict in terminology, the present disclosure is controlling.

Overview

In general, a collapsible watercraft in accordance with the present teachings comprises a single-piece sheet having a plurality of predefined creases (AKA living hinges) at which the sheet is foldable to form a hull. The watercraft is configured to transition between a stowed state and a deployed (or assembled) state by folding or unfolding along the plurality of predefined creases or fold lines. In the stowed state, the foldable sheet of the watercraft may form a self-contained, portable carrying case, which is more convenient to transport that a conventional watercraft. In the deployed state, the foldable sheet forms a body (e.g., a hull, deck, and/or sides) of the watercraft. The body includes a midship portion of the watercraft defining a cockpit. While other watercraft topologies (such as canoes) may be utilized, the examples shown and described herein are in the form of kayaks.

The stern end of the foldable sheet is permanently folded in a forked (AKA swallowtail) configuration to form a closed transom of the kayak. The foldable sheet is therefore configured such that transom of the watercraft at least generally retains its shape in both the deployed state and the stowed state. In some examples, the kayak includes a fairing (e.g., rigid fairing, tape fairing, etc.) configured to cover portions of the bow and stern, e.g., to protect the watercraft from damage.

The collapsible kayak of the present disclosure includes at least one floorboard releasably couplable to the cockpit. When installed, the floorboard provides structural support to the kayak and supports one or more passenger seats. The floorboard is configured to fit under a pair of lateral, integrated walls of the cockpit. The lateral walls of the cockpit are configured to be permanently attached, e.g., to the gunwales of the midship side portions of the watercraft. In some examples, the watercraft may include more than one floorboard, either identical or different.

The floorboard folds into (e.g., three) sections along creases that are oriented side-to-side (i.e., athwartships or transverse to the hull). A foam seat is affixed (e.g., permanently) to the floorboard (e.g., using screws or rivets).

In some examples, a reinforced edge portion may be coupled to the foldable sheet and configured to form portions of the gunwale. The reinforced edge may be configured to reinforce the cockpit and/or increase the freeboard of the watercraft as compared with other designs.

As mentioned above, the collapsible watercraft may be a kayak. In some embodiments, the collapsible watercraft may comprise a canoe, a rowboat, a raft or rafting boat, and/or any other suitable non-motorized or motorized watercraft.

Examples, Components, and Alternatives

The following sections describe selected aspects of illustrative watercraft as well as related systems and/or methods. The examples in these sections are intended for illustration and should not be interpreted as limiting the scope of the present disclosure. Each section may include one or more distinct embodiments or examples, and/or contextual or related information, function, and/or structure.

A. Illustrative Collapsible Watercraft

As shown in FIGS. 1-21, this section describes an illustrative collapsible kayak 100, which is an example of the collapsible watercraft described above. Kayak 100 is configured to be transitionable between a deployed configuration and a self-contained box configuration. In the deployed configuration, a rigid monocoque structure is formed by the three-dimensional fold pattern. FIG. 1 depicts kayak 100 in a deployed configuration, with a foldable sheet 110 folded into a kayak body 112 (AKA hull). Foldable sheet 110 is made of a strong material suitable for deployment in a body of water, for example, hollow-core sheets of corrugated and/or honeycomb polypropylene and/or polyethylene, although other waterproof, resilient materials may be used. Folded sheet 110 includes a plurality of predefined fold lines 114, also referred to as creases or living hinges. Fold lines 114 comprise creases along which foldable sheet 110 is configured to fold. Foldable sheet 110 is configured to be assembled (e.g., to form kayak 100) by folding along fold lines 114. In the assembled state (AKA the deployed state), foldable sheet 110 forms body 112 (also referred to as the hull) of kayak 100.

As shown in FIG. 1, kayak 100 has a front or bow portion 116, a rear or stern portion 118, and a midship portion 120 extending between the bow and stern portions. Bow portion 116 and stern portion 118 each include a first deck panel 122 and a second deck panel 124 opposite the corresponding first deck panel 122.

Figure 2:
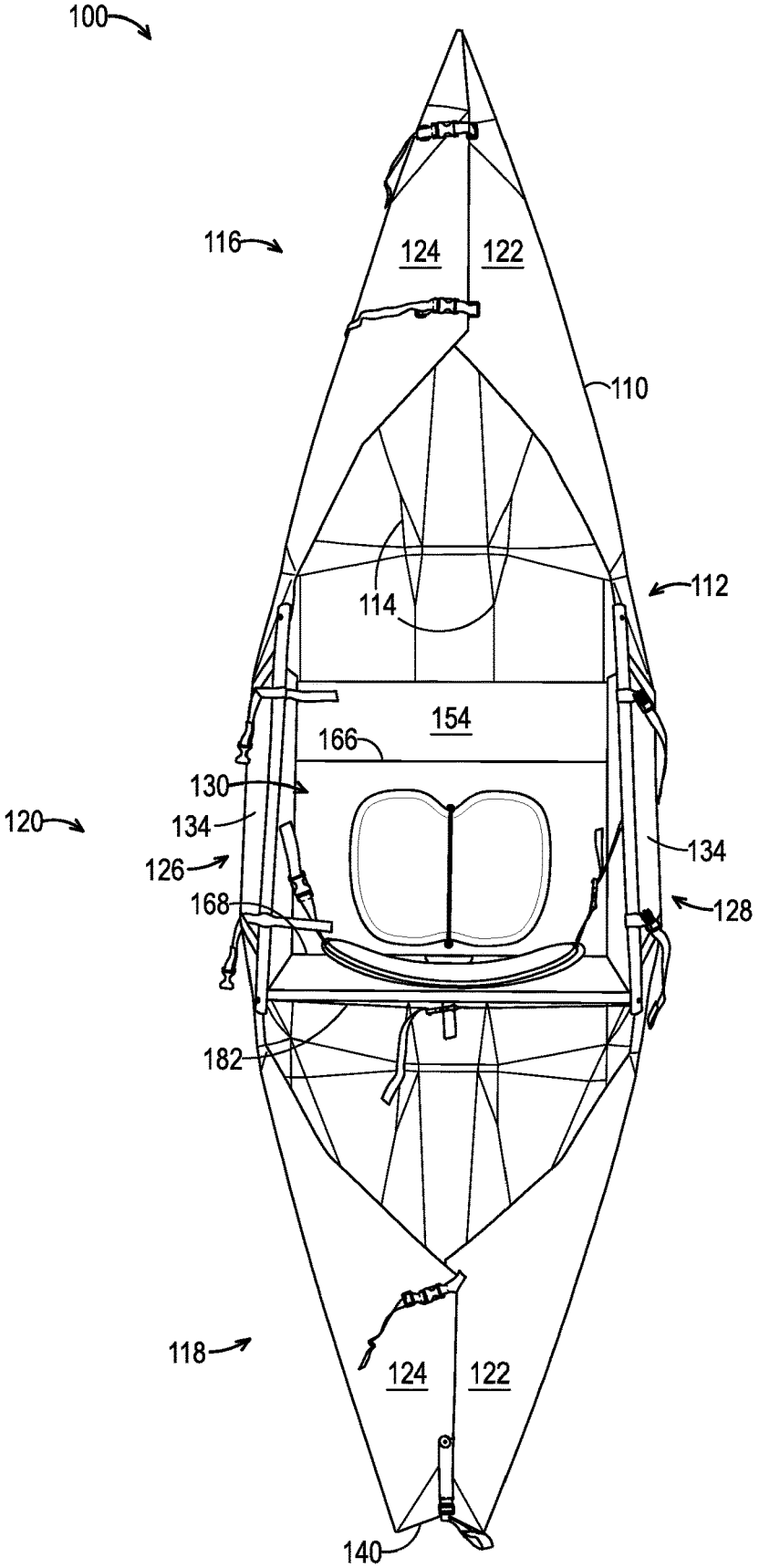
FIG. 2 is a top plan view of the collapsible watercraft of FIG. 1.
Figure 3:
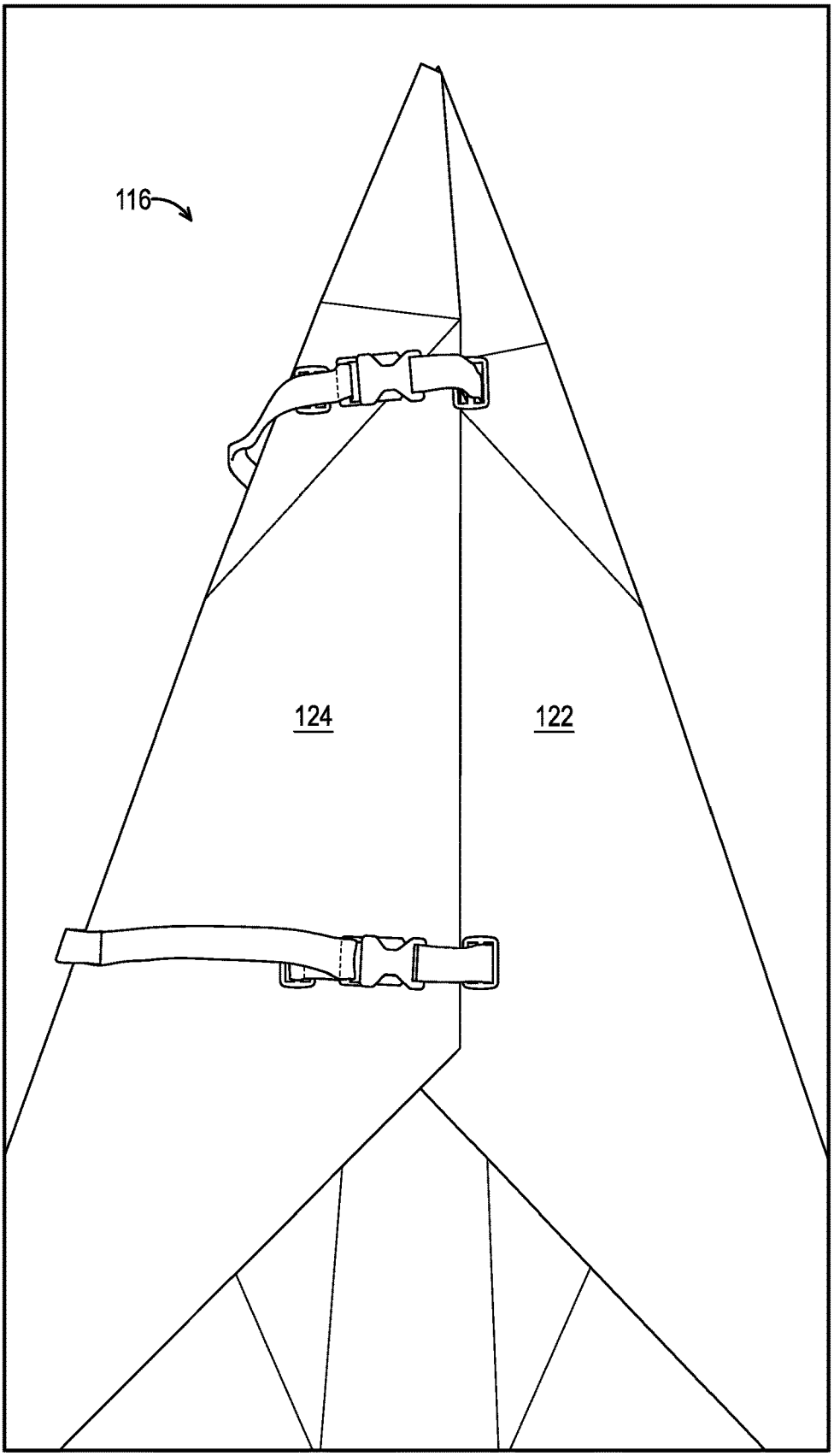
FIG. 3 is a top plan view of a bow portion of the watercraft of FIG. 1.
Figure 4:
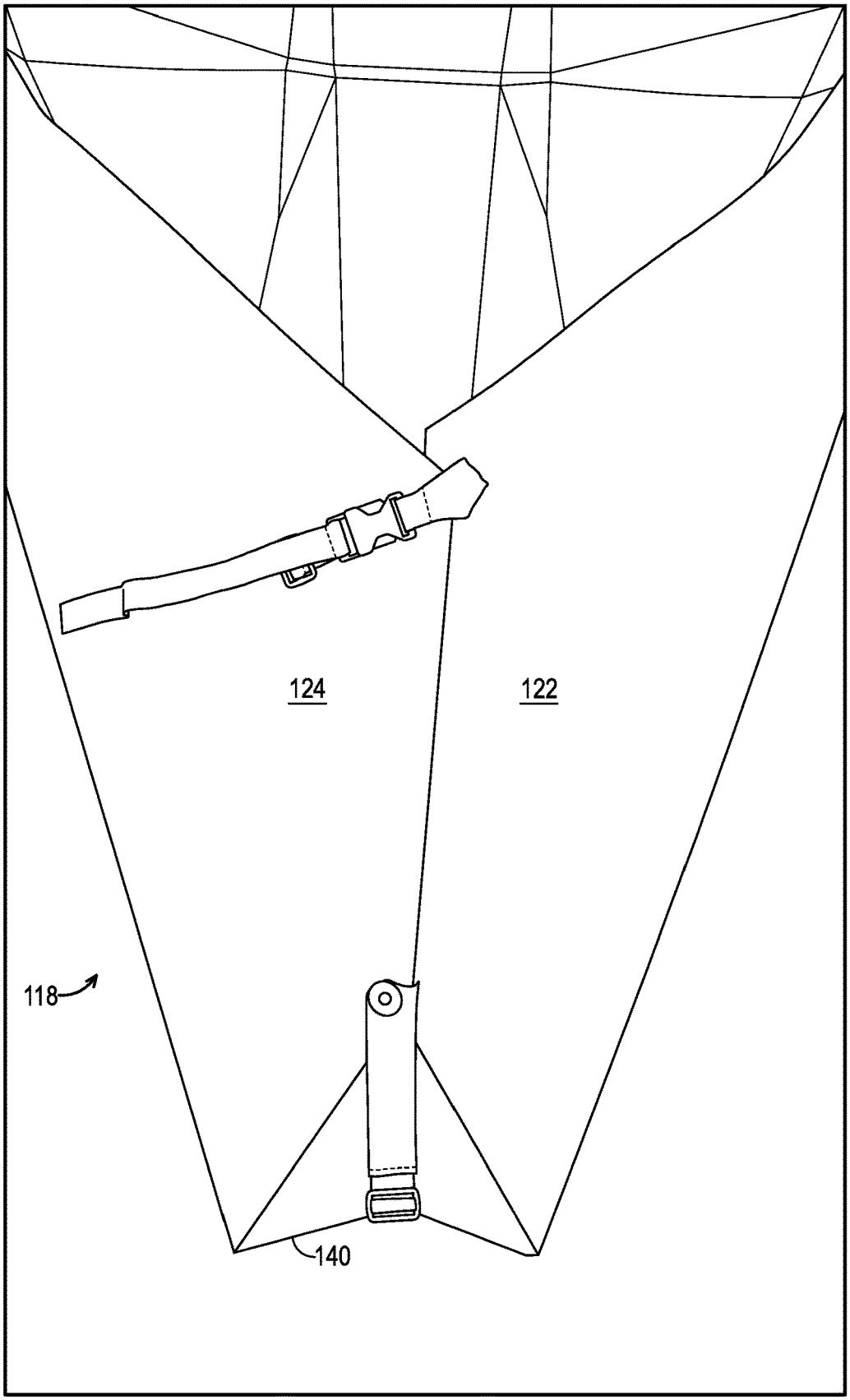
FIG. 4 is a top plan view of a stern portion of the watercraft of FIG. 1.

As shown in FIGS. 2-4, when kayak 100 is in the deployed state, first deck panel 122 and second deck panel 124 in both the bow portion and the stern portion are brought together such that second deck panel 124 at least partially overlaps first deck panel 122. Straps and buckles attached to the first deck panels and second deck panels are utilized to releasably secure the deck panels. To easily accommodate the overlap, first deck portion 122 is longer than second deck portion 124. The overlap of the second deck panel with the first deck panel allows each of the bow and stern portions of the kayak to be formed without precisely aligning the edges of foldable sheet 110, thereby increasing the ease of assembly of the kayak, and additionally aides in forming a watertight seal therebetween.

Midship portion 120 includes a pair of opposing midship side portions 126, 128 defining between them a cockpit 130. Each midship side portion 126, 128 includes a midship outer panel 132 (see FIG. 1), a midship gunwale panel 134, and a coupled cockpit side wall 136 (see FIGS. 11, 12) connected to the midship gunwale panel. In the assembled state, outer panels 132 form outer walls of the kayak hull, gunwale panels 134 form gunwales of the kayak, and cockpit side walls 136 are oriented vertically, orthogonal to a cockpit floor 138. Side walls 136 may be (e.g., permanently) coupled or affixed to foldable sheet 110, e.g., using screws, rivets, or welds. Cockpit side walls 136 are configured to retain the floorboard of the kayak, as described in further detail below (see FIGS. 11, 12). Resilient edge fittings 130 may be disposed along the connection between midship gunwale panel 134 and cockpit side walls 136.

Turning now to FIG. 5-10, a transom 140 of stern 118 is shown to be folded and permanently closed with a V-shaped (AKA forked/swallowtail-shaped) construction. In other words, a centerline of the transom is disposed farther forward than outboard edges of the transom. This configuration provides a tight and visually distinctive closure and advantageously provides a water-tight finish to the stern portion of the kayak without the need for further coverings and/or fairings which may be easily damaged by abrasion and require an extra assembly step.

Figure 5:
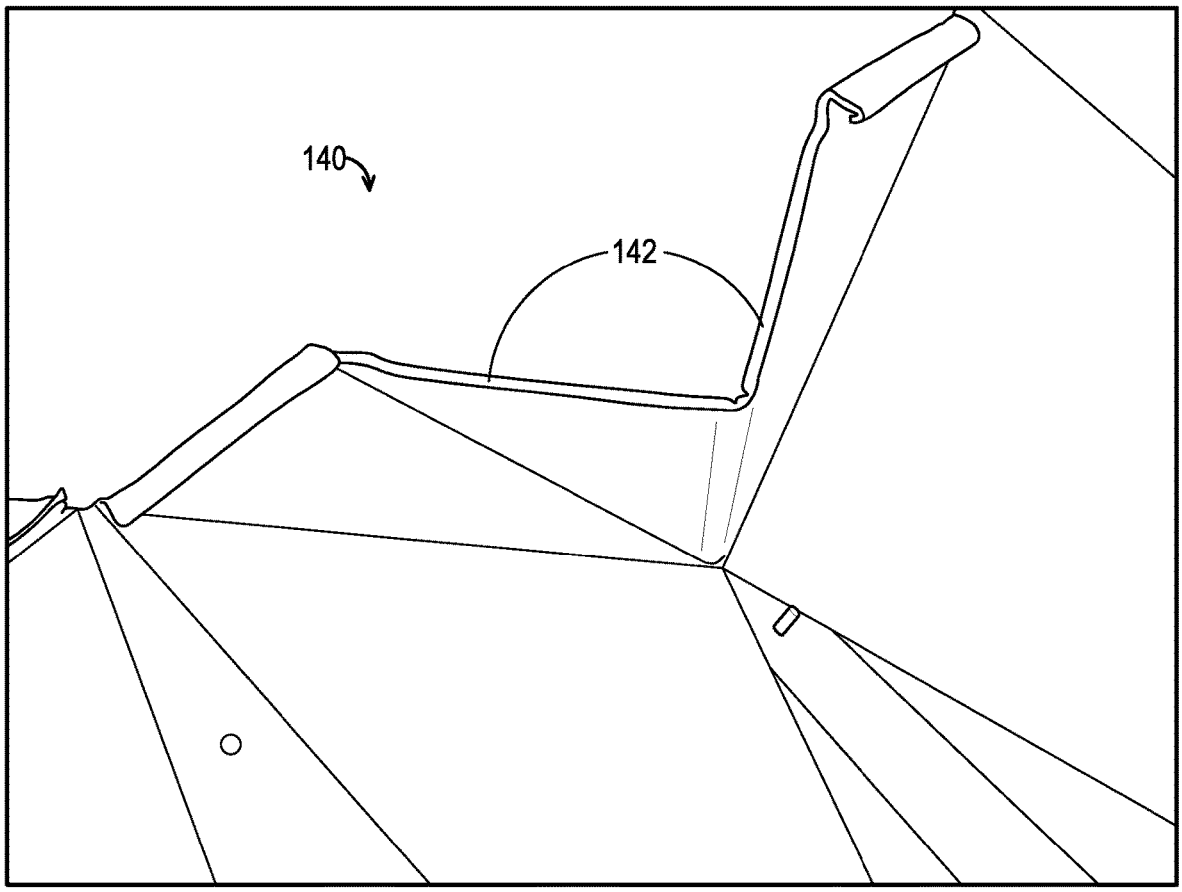
FIG. 5 is a perspective view of a partially assembled transom of the watercraft of FIG. 1.
Figure 6:
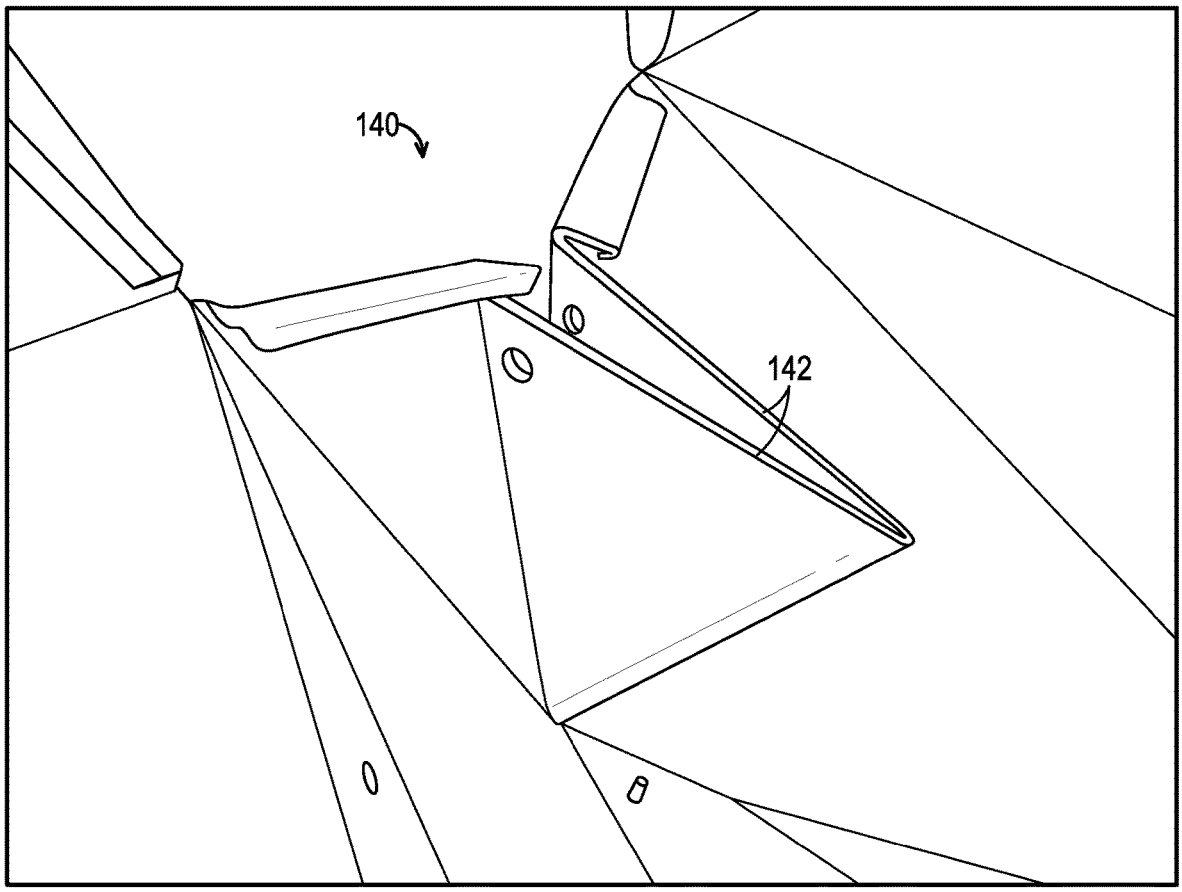
FIG. 6 is a perspective view of the partially assembled transom of FIG. 5.
Figure 7:
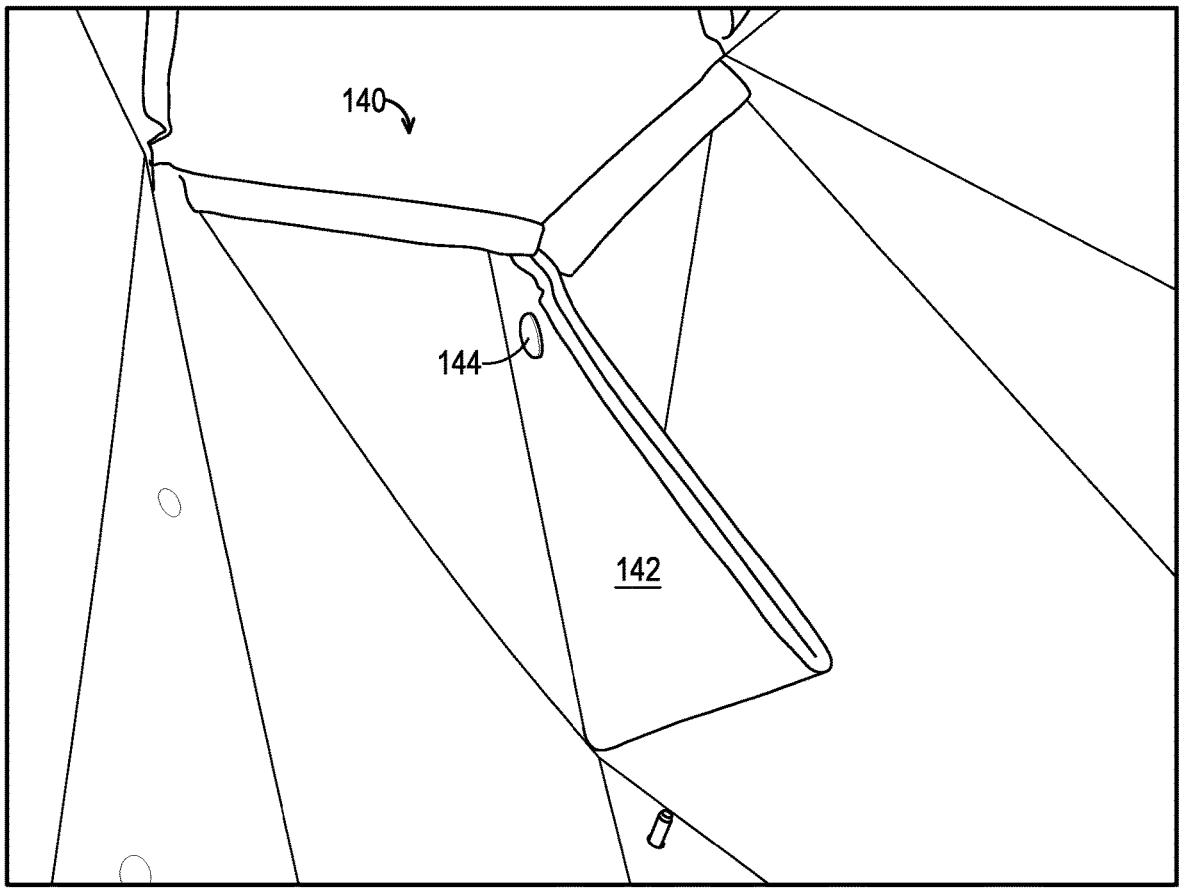
FIG. 7 is a perspective view of the assembled transom of FIG. 5.

With respect to FIGS. 5-7, the swallowtail-shaped fold construction of transom 140 is formed by folding inwards two triangular portions 142 of the foldable sheet. The two folded portions are then affixed to one another with a fastener 144 forming the V-shaped transom. By forming transom 140 in this manner, the width of stern 118 can be kept fixed (i.e., unable to collapse/change) when transitioning to the stowed configuration, thereby providing additional structure when in the stowed configuration.

Figure 8:
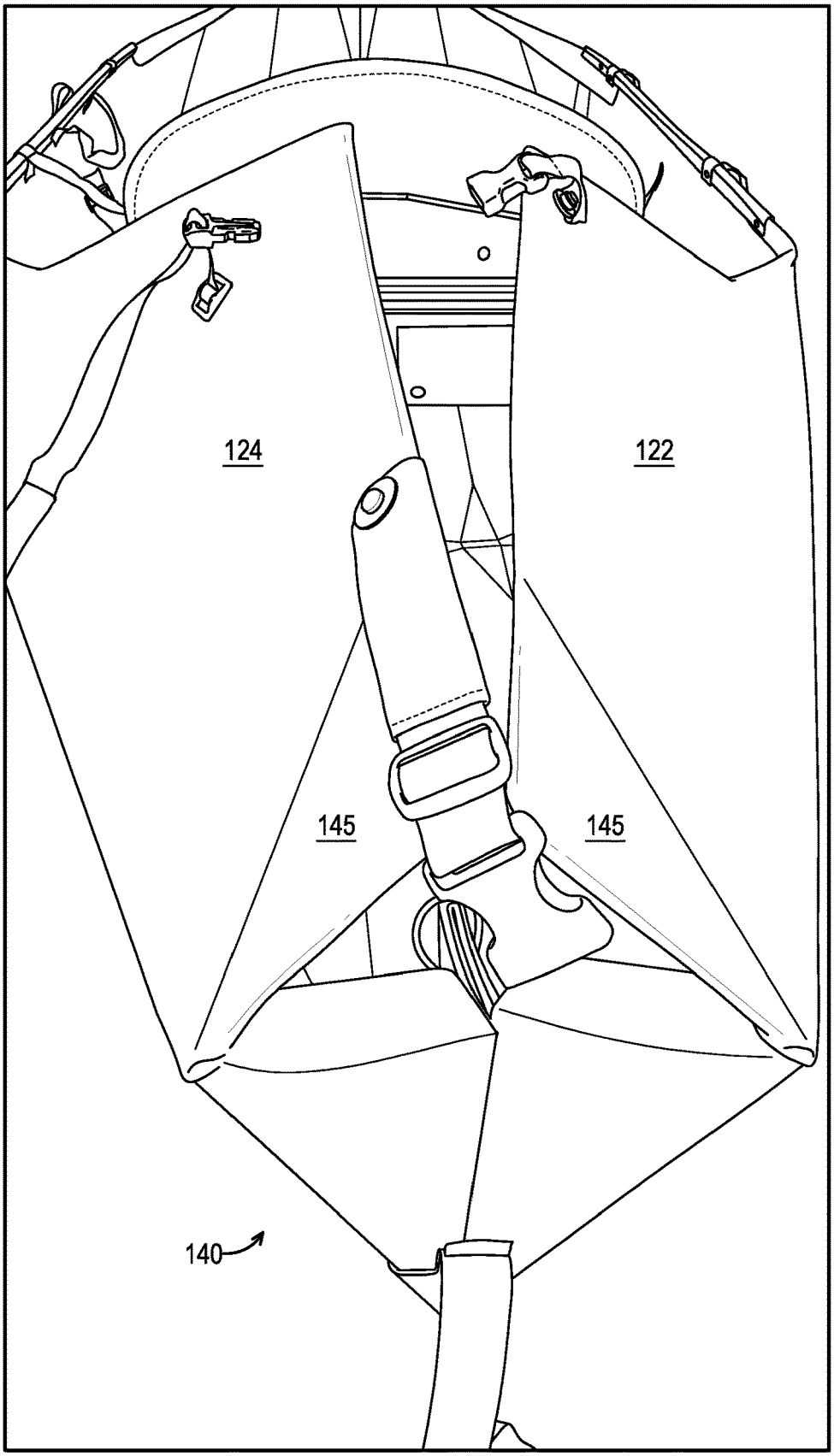
FIG. 8 is a perspective view of the stern portion of FIG. 4, depicting the transom of FIG. 5.
Figure 9:
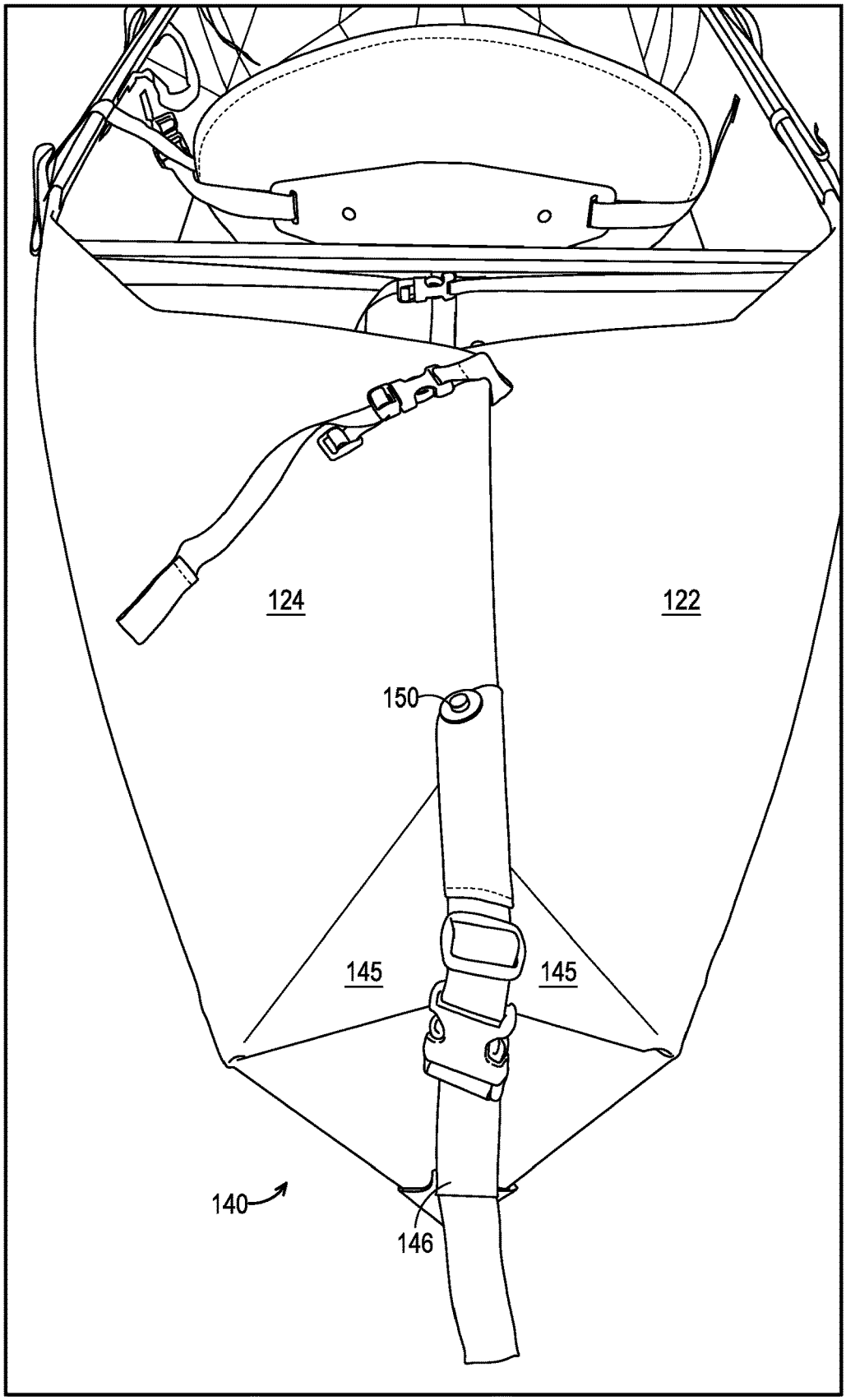
FIG. 9 is a perspective view of the stern portion of FIG. 4, depicting the transom of FIG. 5.
Figure 10:
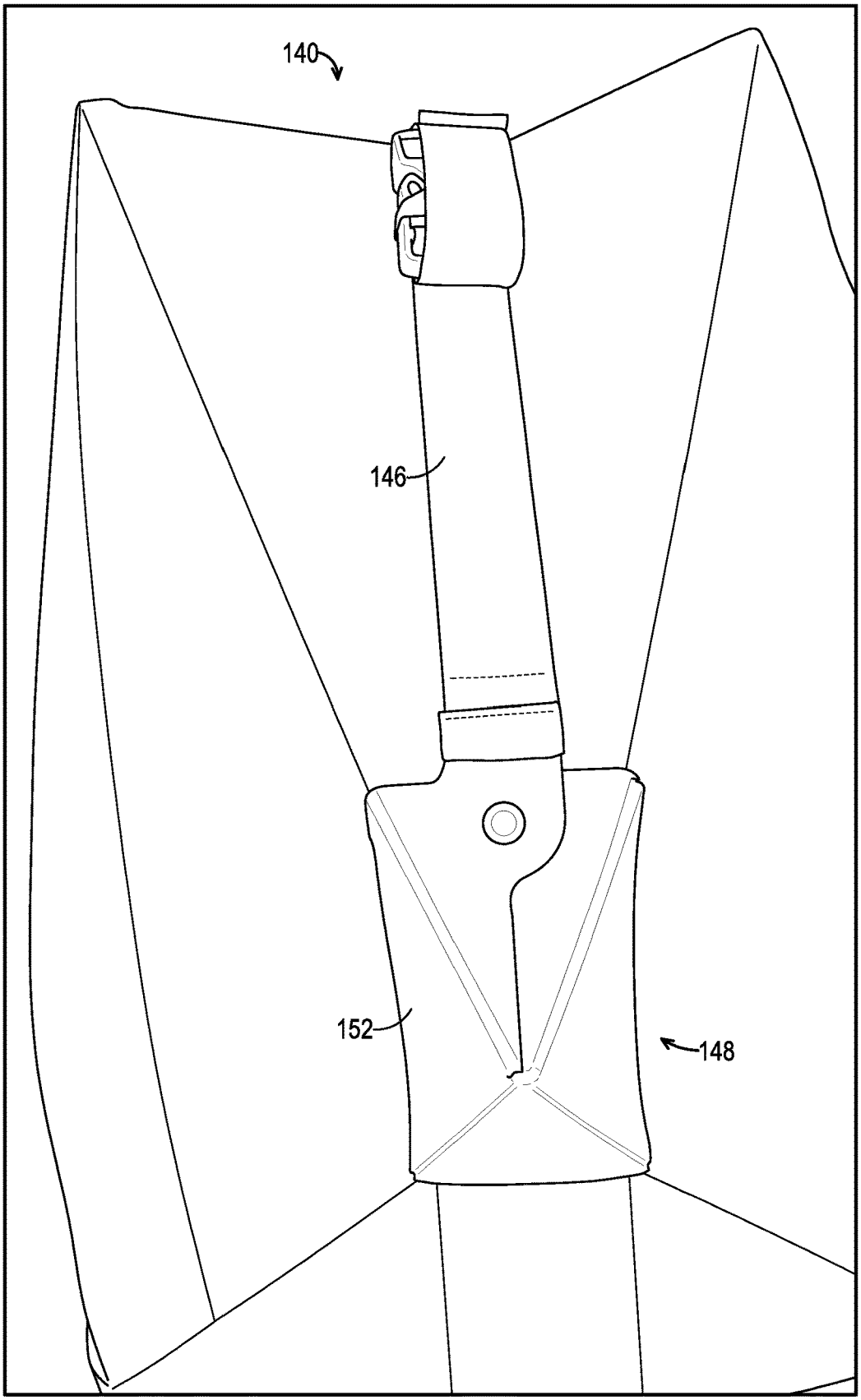
FIG. 10 is a rear elevation view of the stern portion of FIG. 4, depicting the transom of FIG. 5.

Turning to FIGS. 8 and 9, when assembling into the deployed configuration, two triangular darts 145 of first and second deck panels 122, 124 of stern portion 118 are brought to meet the edges of the folded transom 140. As shown in FIGS. 9, 10, a strap 146 is utilized to secure a bottom rear corner 148 of the kayak to a connection point 150 on second deck panel 124. In some examples, bottom rear corner 148 has a portion of protective material 152 disposed thereon to provide additional support to the strap as well as protect the hull from external damage, e.g., from dragging the kayak on the ground. Tightening strap 146 has the effect of pulling triangular darts 144 into tight alignment with V-shaped transom 140. In some examples, plastic, rubber, or foam profiles may be used between the interface of triangular darts 144 and transom 140 to create a more watertight seal.

Figure 11:
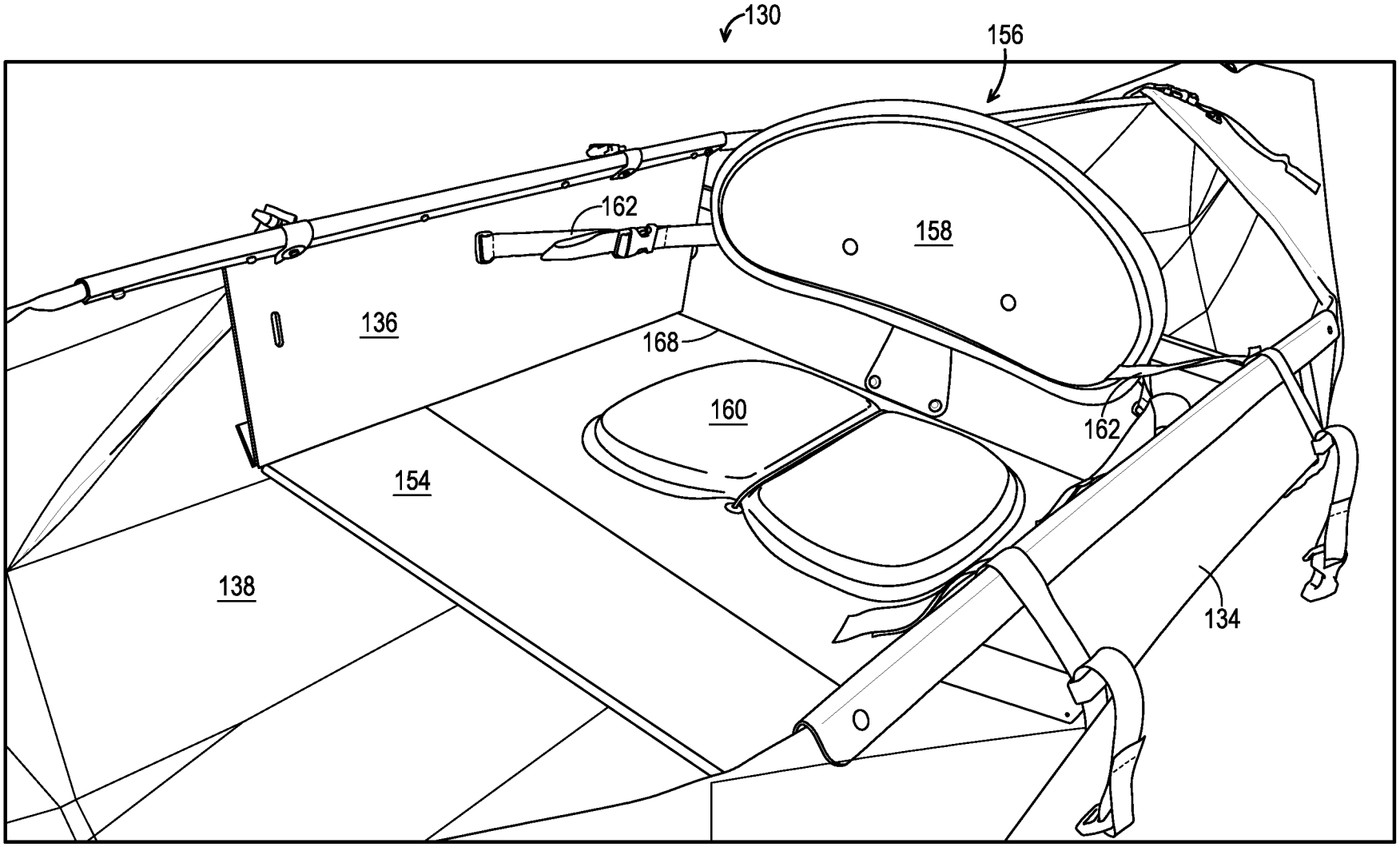
FIG. 11 is a perspective view of the cockpit of the collapsible watercraft of FIG. 1.
Figure 12:
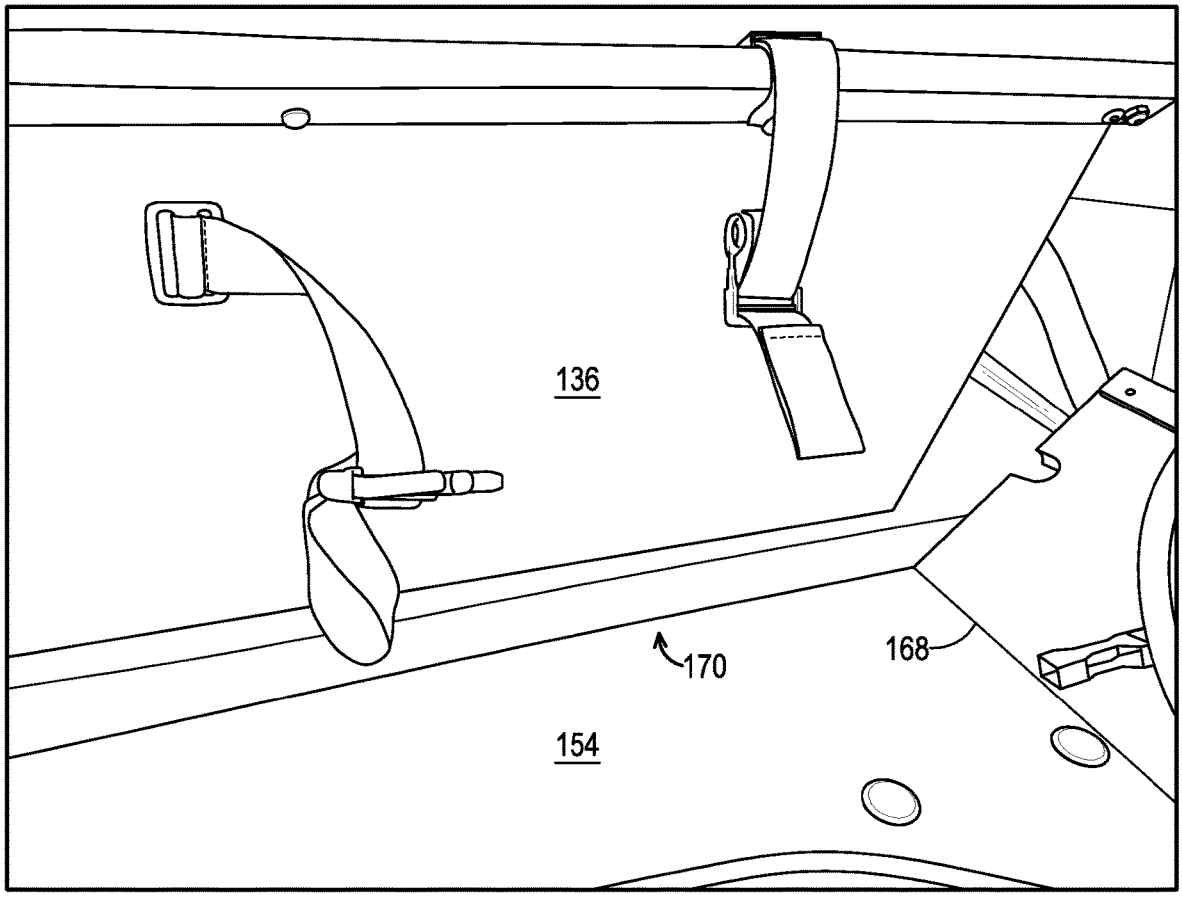
FIG. 12 is a perspective view of portions of the floorboard and side wall of the cockpit of FIG. 11.
Figure 13:
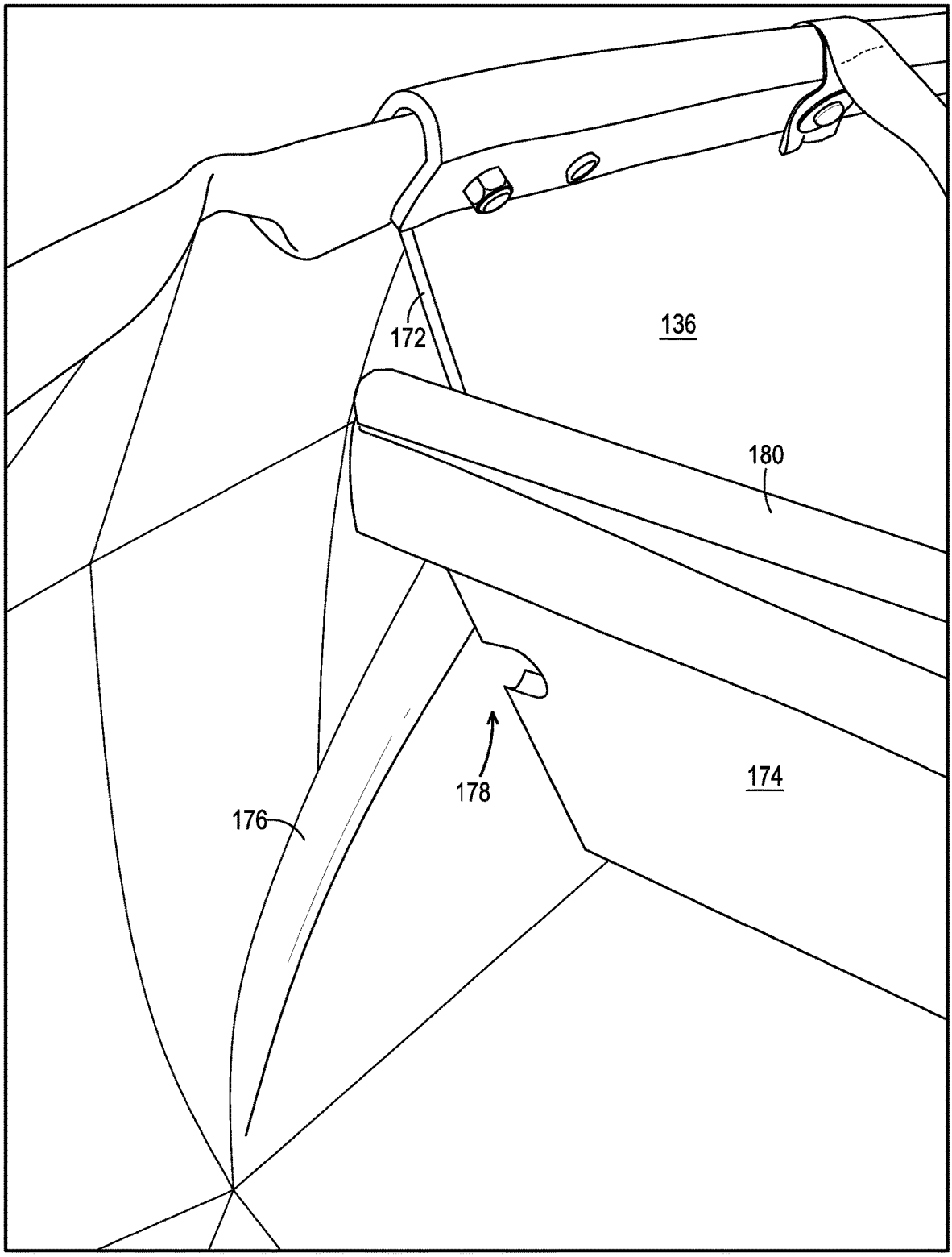
FIG. 13 is a perspective view of a portion of the floorboard and sidewall of FIG. 12.

Turning to FIGS. 11-13, kayak 100 includes a floorboard 154 having a seat assembly 156. Seat assembly 156 includes a seat backrest 158 and a seating support surface 160, such that an occupant can sit on seating surface 160 and lean back against seat back 158. Seating surface 160 may include any cushioned or uncushioned surface suitable for supporting an occupant in a seated position.

Respective straps 162 are attached to the port and starboard sides of seat backrest 158 and coupled to the hull, (e.g., by stitching, screws, adhesive, rivets, and/or other fasteners). Accordingly, straps 162 aid in retaining the seat assembly, as well as providing tension abeam the cockpit. In some examples, another suitable seating surface may be used, for example a raised bench, a webbed sling, etc.

Floorboard 154 may comprise any material suitable for supporting one or more kayak occupants and providing structure to the kayak cockpit. In some examples, floorboard 154 comprises a corrugated sheet of a suitable thermoplastic polymer, such as a heavy-duty corrugated polypropylene. In some examples, floorboard 154 has a thickness in the range of 5 millimeters (mm) to 15 mm. In some examples, floorboard 500 is 8 mm to 10 mm thick.

Floorboard 154 is configured to fold along fold lines 166, 168 to provide rigidity and for compact storage in the stored state. Both the orientation of fold lines 166, 168 and the folded topology contribute to these features. In general, a floorboard is an important element of many kayaks, as the floorboard facilitates distribution of the weight of the paddler and also reinforces the cockpit area. The cockpit area is typically the weakest part of the kayak monocoque due to the large opening in the structure. In addition, floorboards facilitate the attachment of seats, strap fasteners, etc., (e.g., using screws or rivets) without penetrating the hull, as penetrations of the hull can result in a vulnerability to leaks.

Previous, known designs of foldable kayaks include folds in the floorboard that are oriented in a longitudinal direction of the kayak (i.e., parallel to a long axis of the monocoque). This orientation is required by these known designs so as to facilitate the transformation from kayak to box. In other words, the orientation of the floorboard creases is generally the same as the orientation of hull creases, such that the overall structure can be folded into a narrower configuration for storage. Unfortunately, this can result in weak points in the structure, especially when the paddler sits on the floorboard inside the kayak as the paddler's weight tends to deform both the floorboard and the bottom of the kayak, resulting in a roughly "U" or "V" shaped bottom. This shape is less desirable with respect to the stability of the kayak. Another disadvantage of known designs is that the seat must be removed before folding the kayak into the box as padded seats typically do not have any fold lines going in the longitudinal direction of the hull.

In contrast, floorboard 154 of kayak 100 is configured to fold along fold lines 166, 168 that are oriented side-to-side (i.e., athwartships or transverse to the hull). Accordingly, the seat may be affixed (e.g., permanently) to the floorboard (e.g., using screws or rivets). The floorboard may comprise a thick corrugated or honeycombed plastic panel (e.g., of polypropylene or polyethylene), which may be folded repeatedly without weakening. When in kayak form, floorboard 154 is placed as shown in FIG. 11, with front fold line 166 flattened, and rear fold line 168 folded up.

Rear fold 168 provides enhanced rigidity in the area of the seat and cockpit. Furthermore, as discussed above, the creases of the floorboard are generally oriented orthogonal to the long axis of the kayak to provide a resistance to/prevention of deflection under the weight of an occupant, resulting in a flat and stable configuration of the bottom of the hull. Furthermore, the additional rigidity created by this configuration eliminates the need for bulkheads or other structural reinforcements.

Turning to FIG. 12, floorboard 154 is inserted into the kayak hull while the kayak decks remain open and unsecured such that the cockpit area is wider than in the fully assembled configuration. This allows the floorboard to be slid into gaps 170 at the bottom of the side walls 136, between a lower edge of side wall 136 and cockpit floor 138 such that the floorboard is prevented from lifting upward once assembly is completed. Additionally, after all of the straps of the kayak have been tightened, gap 170 is tightened creating a friction fit between side wall 136 and floorboard 154. Accordingly, the floorboard is held in place by the side walls on both sides of the kayak cockpit. In some examples, side walls 136 may have a reinforcement layer of material on the bottom edge to further aid in retaining the floorboard.

With respect to FIG. 13, the rear or aft edge 172 of each sideboard is angled (i.e., non-vertical), corresponding to the angle of a rear section 174 of floorboard 154 when installed. To accommodate creases 176 in the kayak hull, notches 178 may be formed in either side of rear section 174 of floorboard 154. A piece of rigid trim 180 may be attached to the rear of back section 174 of the floorboard 154, providing additional reinforcement strength. Trim 180 may comprise plastic, metal, or other suitable rigid material.

The floorboard can be additionally secured in place by an adjustable strap 182 spanning the cockpit, e.g., immediately behind rear section 174 of the floorboard (see FIG. 2). Tightening strap 182 pulls the sides of the cockpit together as well as pulling the rear section 174 of floorboard 154 tight against angled edges 172 of the sideboards, locking the entire system securely in place. In some examples, protruding screws, nuts, or spacers are inserted into the ends of the plastic or metal trim, providing an additional locking mechanism.

To disassemble the kayak into the stowed configuration, the deck of the kayak is opened by unbuckling all of the straps. The floorboard/seat assembly is then removed as a single piece. The two creases in the floorboard are folded toward each other, causing the seat back to fold down onto the seat bottom. The two flaps of the floorboards may be coupled together (e.g., by a strap, snap, or hook-and-loop fastening system), creating a closed package with a triangular cross section.

To fully fold the kayak into the stowed configuration, the folded floorboard/seat package can then be attached to a side of the cockpit (e.g., using two straps, snaps, or hook-and-loop fasteners) and the kayak shell can then folded (see FIGS. 14-20 and corresponding description below). In some examples, the folded floorboard/seat package fits neatly into a corresponding triangular space in the folded kayak box, e.g., between various folds of the kayak shell and the side walls.

Figure 14:
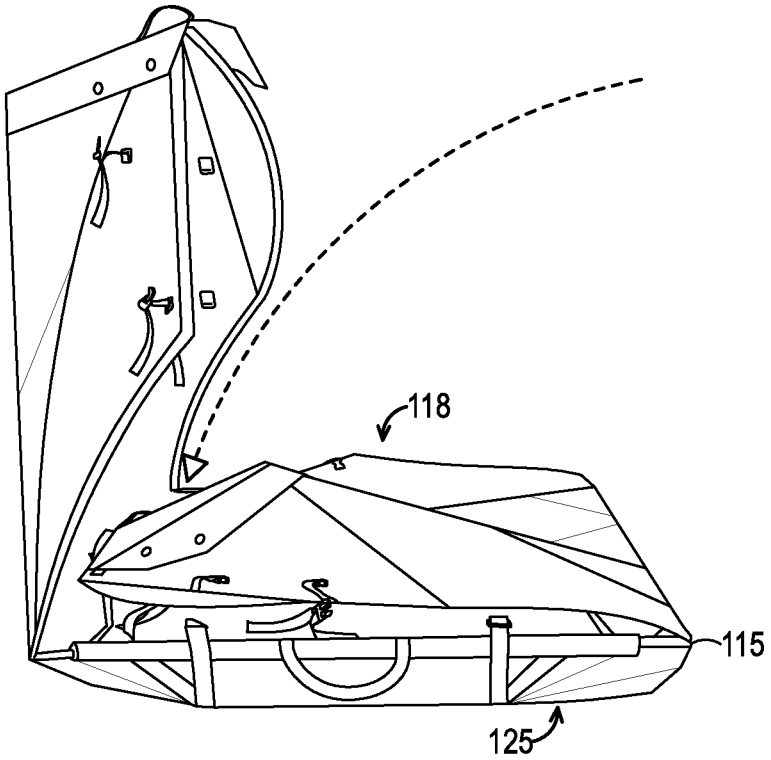
FIG. 14 is a perspective view of the watercraft of FIG. 1 in a partially folded state depicting an illustrative step of folding from a deployed state to a stowed state.
Figure 15:
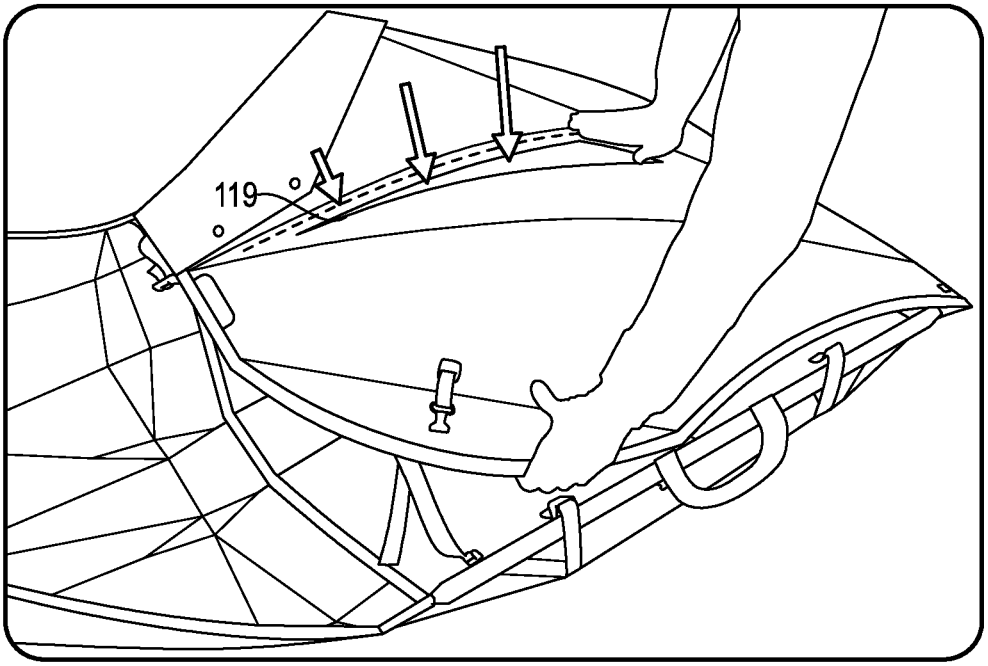
FIG. 15 is a perspective view of the watercraft of FIG. 1 in a partially folded state depicting an illustrative step of folding from a deployed state to a stowed state.
Figure 16:
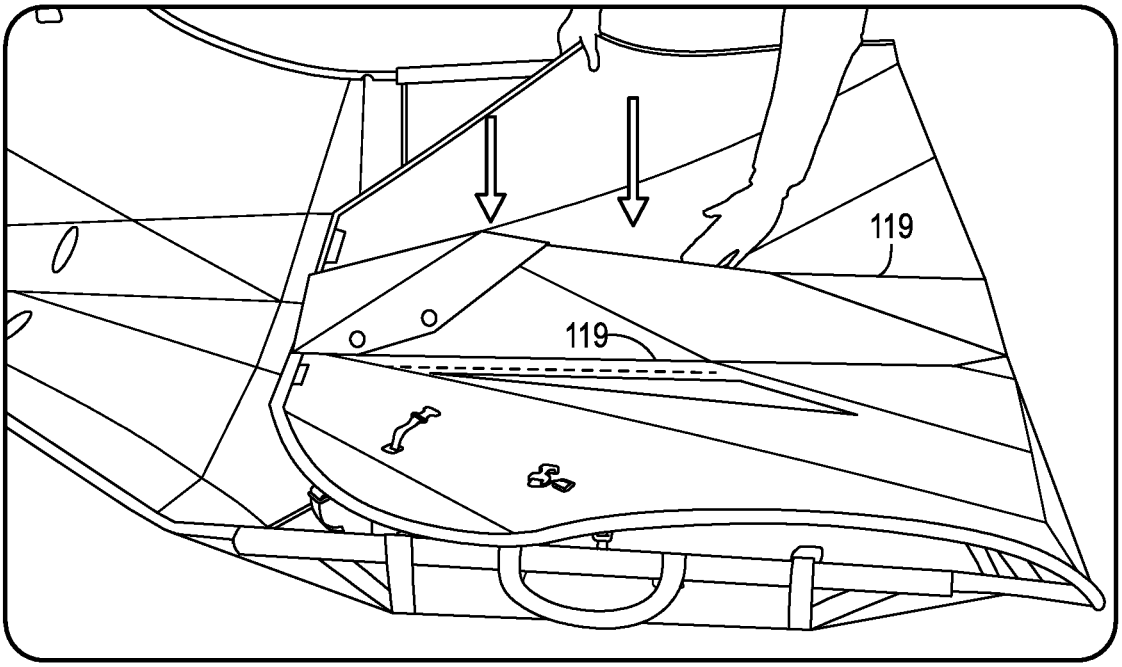
FIG. 16 is a perspective view of the watercraft of FIG. 1 in a partially folded state depicting an illustrative step of folding from a deployed state to a stowed state.

FIGS. 14-20 depict various stages of transitioning kayak 100 to the stowed state. First, a user disengages all straps/fasteners and removes removable components such as floorboard 154. This leaves kayak 100 in a partially disassembled state. As shown in FIG. 14, stern portion 118 is folded onto midship portion 120 along fold lines 115 as indicated by the arrow. As shown in FIGS. 15 and 16, stern portion 118 is collapsed by pressing fold lines 119 downward, as indicated by the arrows. This collapses deck panels 122 and 124 on the stern side inward.

Figure 17:
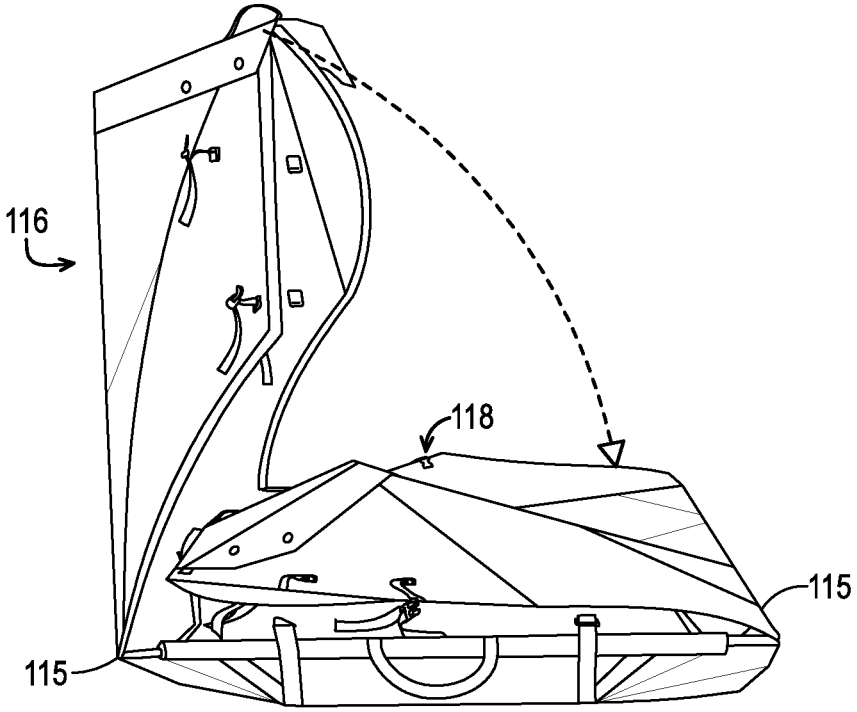
FIG. 17 is a perspective view of the watercraft of FIG. 1 in a partially folded state depicting an illustrative step of folding from a deployed state to a stowed state.
Figure 18:
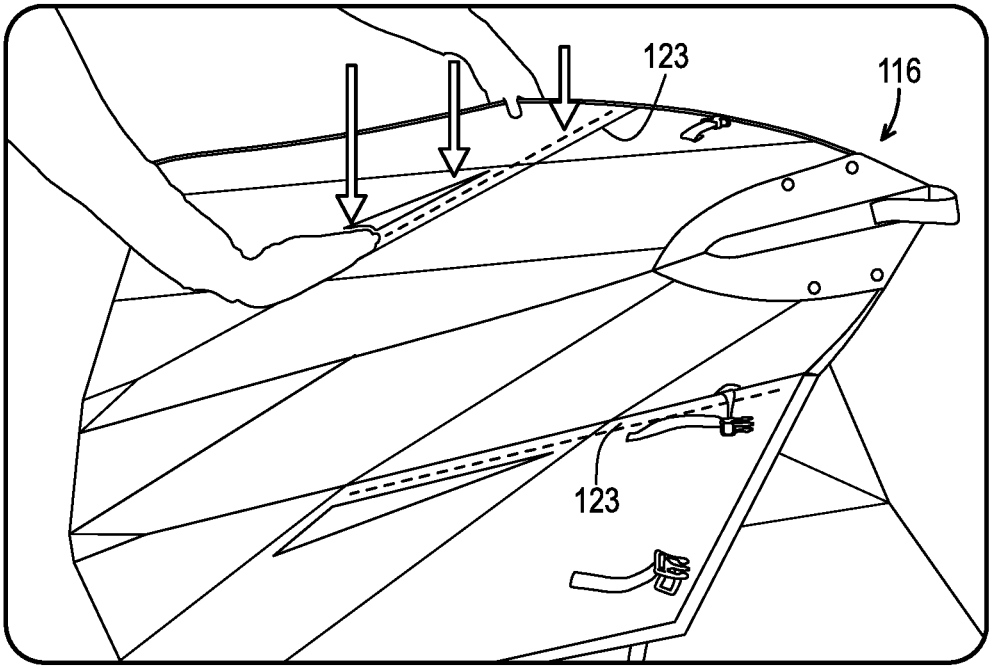
FIG. 18 is a perspective view of the watercraft of FIG. 1 in a partially folded state depicting an illustrative step of folding from a deployed state to a stowed state.

As shown in FIG. 17, bow portion 116 is then folded towards midship portion 120 and onto stern portion 118 as indicated by the arrow. As shown in FIG. 18, bow portion 120 is collapsed by pressing fold lines 123 downward, as indicated by the arrows.

Figure 19:
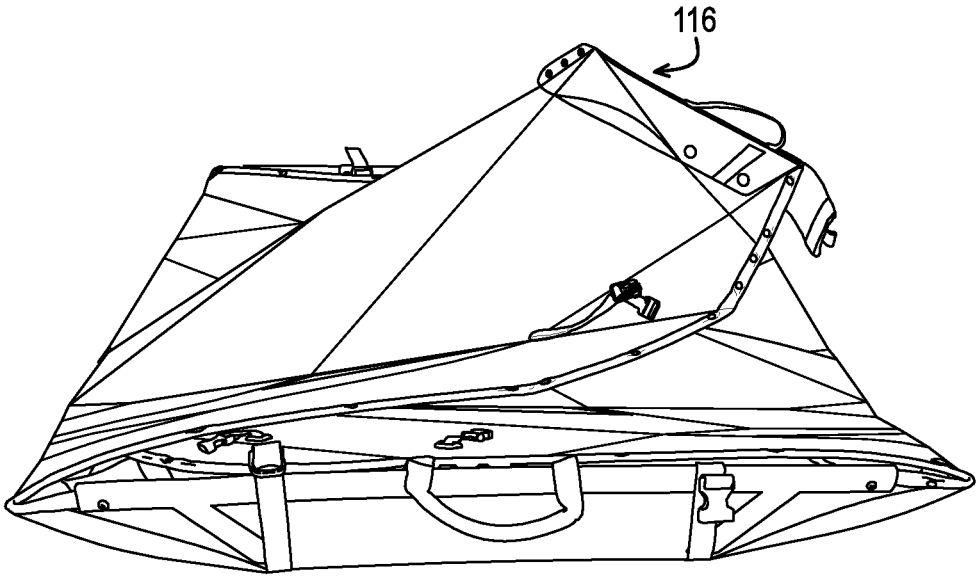
FIG. 19 is a perspective view of the watercraft of FIG. 1 in a partially folded state depicting an illustrative step of folding from a deployed state to a stowed state.
Figure 20:
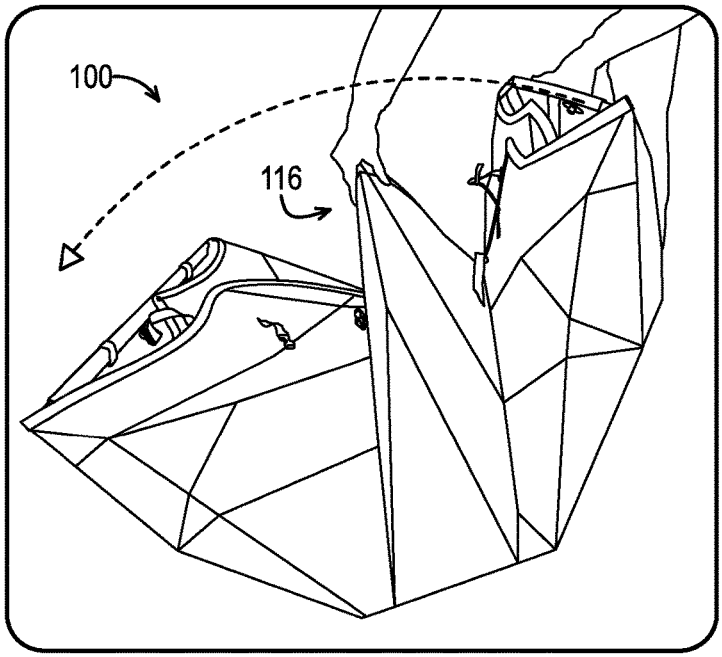
FIG. 20 is a perspective view of the watercraft of FIG. 1 in a partially folded state depicting an illustrative step of folding from a deployed state to a stowed state.

Afterwards, the prow of the kayak is left protruding upward as shown in FIG. 19. Finally, as shown in FIG. 20, kayak 100 may be folded laterally (i.e., orthogonal to a long axis of the kayak) forming portable box 200.

Figure 21:
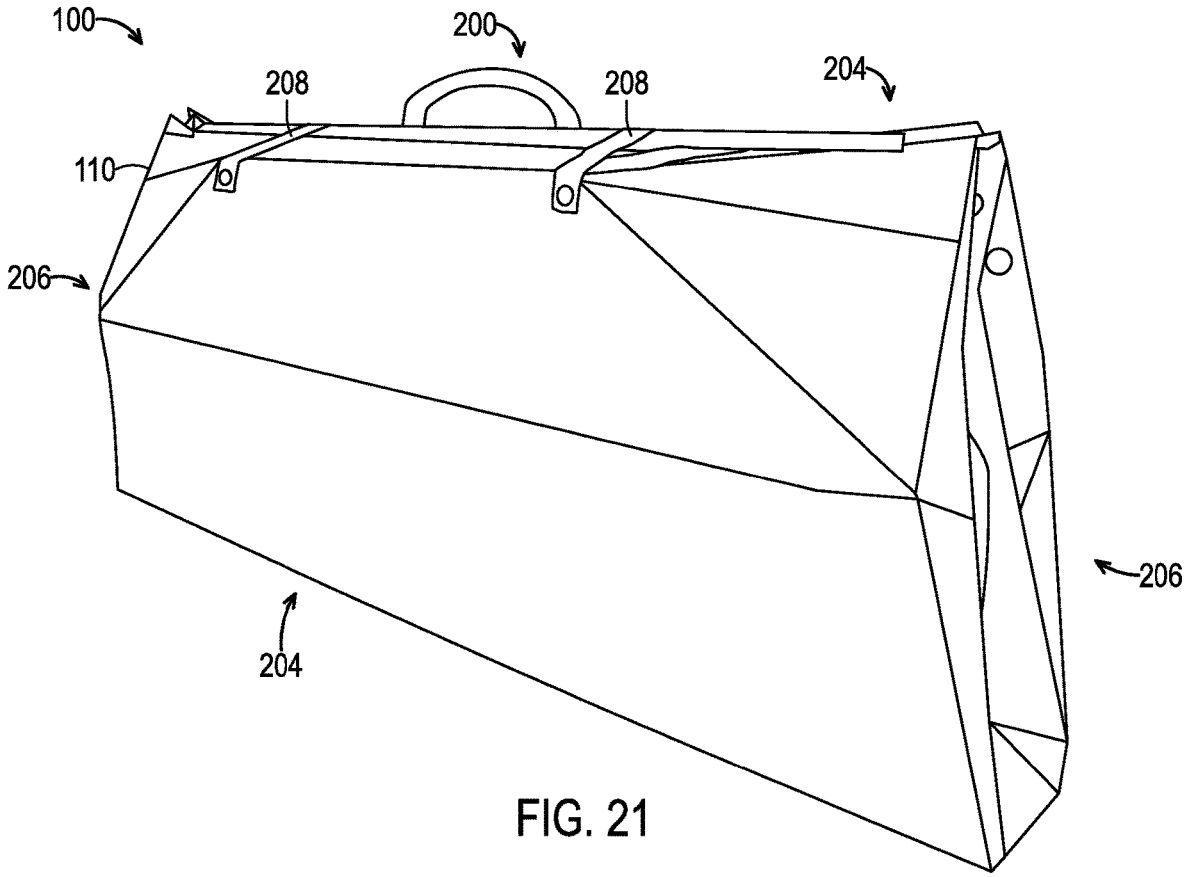
FIG. 21 is a perspective view of the watercraft of FIG. 1 in a stowed state.

FIG. 21 is a front isometric view of kayak 100 in a collapsed or stowed state. In the stowed state, foldable sheet 110 takes the form of a generally rectilinear box 200 or rectangular prism. Box 200 has two opposing sides 204, where foldable sheet 110 may be slightly bulged, and two opposing folded sides 206. Folded sides 206 correspond to folded portions of midship portion 120.

Two pairs of straps 208 disposed at the top of box 200 may be fastened (e.g., buckled) together to further secure foldable sheet 110 in the folded state. The straps may be buckled together with the straps slack and then tightened to compress box 200 to a more compact size.

B. Illustrative Combinations and Additional Examples

This section describes additional aspects and features of a collapsible watercraft, presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A1. A collapsible kayak, comprising:

a continuous sheet forming a hull having a bow portion, a midship portion, and a stern portion, the hull including a plurality of living hinges along which the hull is foldable, at least one of the living hinges of the hull having a fore-and-aft orientation in the midship portion; and a removable floorboard disposed in the midship portion of the hull, the floorboard being configured to fold only at one or more creases oriented in respective athwartships directions.

A2. The collapsible kayak of A1, wherein when the kayak is assembled the removable floorboard is held in place by a friction fit with the hull.

A3. The collapsible kayak of A1 or A2, wherein the removable floorboard is held in place by a multi-use fastener.

A4. The collapsible kayak of any one of paragraphs A1 through A3, further comprising a pair of side walls disposed in the midship portion, each of the side walls extending downward from a respective gunwale of the hull.

A5. The collapsible kayak of A4, wherein an upper end of each of the side walls is fixed to the respective gunwale.

A6. The collapsible kayak of A5, wherein a lower end of each of the side walls extends to a selected height above a floor of the hull, forming a gap between the side wall and the hull.

A7. The collapsible kayak of A6, wherein outboard edges of the floorboard are configured to fit into the respective gaps between the side walls and the floor of the hull.

A8. The collapsible kayak of any one of paragraphs A1 through A7, wherein an aft edge of the removable floorboard is folded upward when installed.

A9. The collapsible kayak of any one of paragraphs A1 through A8, further comprising a padded seat affixed to an upper surface of the removable floorboard.

A10. The collapsible kayak of any one of paragraphs A1 through A9, wherein the removable floorboard extends across an entire width of a floor of the hull, such that the removable floorboard is configured to oppose inward collapsing of the midship portion.

A11. The collapsible kayak of any one of paragraphs A1 through A10, wherein the bow, stern, and midship portions are configured as a tri-fold, such that the bow portion and the stern portion of the kayak are foldable toward each other and overlap each other at the midship portion when collapsed.

A12. The collapsible kayak of any one of paragraphs A1 through A11, wherein the hull comprises a closed transom having a V-shaped profile, such that a centerline of the transom is disposed farther forward than outboard edges of the transom.

A13. The collapsible kayak of any one of paragraphs A1 through A12, wherein the hull further comprises a first pair of flaps configured to overlap and be strapped together to form an aft deck surface over the stern portion of the hull.

A14. The collapsible kayak of any one of paragraphs A1 through A13, wherein the hull further comprises a second pair of flaps configured to overlap and be strapped together to form a forward deck surface over the bow portion of the hull.

B1. A collapsible kayak, comprising:

a continuous sheet forming a single-piece hull having a bow portion, a midship portion, and a stern portion, the hull including a plurality of crease lines along which the hull is foldable, at least one of the crease lines of the hull having a longitudinal orientation; and a foldable floorboard disposed in the midship portion of the hull, the floorboard being configured to fold only at one or more creases oriented in respective athwartships directions;

wherein the foldable floorboard extends across an entire width of a floor of the hull, such that the foldable floorboard is configured to oppose inward collapsing of the midship portion.

B2. The collapsible kayak of B1, wherein when the kayak is assembled the foldable floorboard is held in place by a multi-use fastener.

B3. The collapsible kayak of B1 or B2, further comprising a pair of side walls disposed in the midship portion, each of the side walls extending downward from a respective gunwale of the hull.

B4. The collapsible kayak of B3, wherein an upper end of each of the side walls is fixed to the respective gunwale.

B5. The collapsible kayak of B4, wherein a lower end of each of the side walls extends to a selected height above a floor of the hull, forming a gap between the side wall and the hull.

B6. The collapsible kayak of B5, wherein outboard edges of the floorboard are configured to fit into the respective gaps between the side walls and the floor of the hull.

B7. The collapsible kayak of any one of paragraphs B1 through B6, wherein an aft edge of the foldable floorboard is folded upward when installed.

B8. The collapsible kayak of any one of paragraphs B1 through B7, further comprising a padded seat affixed to an upper surface of the foldable floorboard.

B9. The collapsible kayak of any one of paragraphs B1 through B8, wherein the bow, stern, and midship portions are configured as a tri-fold, such that the bow portion and the stern portion of the kayak are foldable toward each other and overlap each other at the midship portion when collapsed.

B10. The collapsible kayak of any one of paragraphs B1 through B9, wherein the hull comprises a closed transom having a V-shaped profile, such that a centerline of the transom is disposed farther forward than outboard edges of the transom.

B11. The collapsible kayak of any one of paragraphs B1 through B10, wherein the hull further comprises a first pair of flaps configured to overlap and be strapped together to form an aft deck surface over the stern portion of the hull.

B12. The collapsible kayak of any one of paragraphs B1 through B11, wherein the hull further comprises a second pair of flaps configured to overlap and be strapped together to form a forward deck surface over the bow portion of the hull.

Advantages, Features, and Benefits

The different embodiments and examples of the collapsible watercraft described herein provide several advantages over known solutions. For example, illustrative embodiments and examples described herein allow a more rigid cockpit structure.

Additionally, and among other benefits, illustrative embodiments and examples described herein allow simplified assembly, having only one removable loose part.

Additionally, and among other benefits, illustrative embodiments and examples described herein have an increased rigidity without the need for bulkheads.

Additionally, and among other benefits, illustrative embodiments and examples described herein have watertight end closures without needing extra coverings, saving cost and weight and improving appearance.

Additionally, and among other benefits, illustrative embodiments and examples described herein allow a more economical manufacturing process.

Additionally, and among other benefits, illustrative embodiments and examples described herein have a lower weight than known folding kayaks of similar size.

No known system or device can perform these functions. However, not all embodiments and examples described herein provide the same advantages or the same degree of advantage.

Conclusion

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

The invention claimed is:

1. A collapsible kayak, comprising:

a continuous sheet forming a hull having a bow portion, a midship portion, and a stern portion, the hull including a plurality of living hinges along which the hull is foldable, at least one of the living hinges of the hull having a fore-and-aft orientation in the midship portion; and a removable floorboard disposed in the midship portion of the hull, the floorboard being configured to fold only at one or more creases oriented in respective athwartships directions.

2. The collapsible kayak of claim 1, wherein when the kayak is assembled the removable floorboard is held in place by a friction fit with the hull.

3. The collapsible kayak of claim 1, wherein the removable floorboard is held in place by a multi-use fastener.

4. The collapsible kayak of claim 1, further comprising a pair of side walls disposed in the midship portion, each of the side walls extending downward from a respective gunwale of the hull, wherein an upper end of each of the side walls is fixed to the respective gunwale.

5. The collapsible kayak of claim 4, wherein a lower end of each of the side walls extends to a selected height above a floor of the hull, forming a gap between the side wall and the hull; wherein outboard edges of the floorboard are configured to fit into the respective gaps between the side walls and the floor of the hull.

6. The collapsible kayak of claim 1, wherein an aft edge of the removable floorboard is configured to be folded upward when the floorboard is installed.

7. The collapsible kayak of claim 1, wherein the removable floorboard extends across an entire width of a floor of the hull, such that the removable floorboard is configured to oppose inward collapsing of the midship portion.

8. The collapsible kayak of claim 1, wherein the bow, stern, and midship portions are configured as a tri-fold, such that the bow portion and the stern portion of the kayak are foldable toward each other and overlap each other at the midship portion when collapsed.

9. The collapsible kayak of claim 1, wherein the hull comprises a closed transom having a V-shaped profile, such that a centerline of the transom is disposed farther forward than outboard edges of the transom.

10. The collapsible kayak of claim 1, wherein the hull further comprises a first pair of flaps configured to overlap and be strapped together to form an aft deck surface over the stern portion of the hull.

11. A collapsible kayak, comprising:

a continuous sheet forming a single-piece hull having a bow portion, a midship portion, and a stern portion, the hull including a plurality of crease lines along which the hull is foldable, at least one of the crease lines of the hull having a longitudinal orientation; and a foldable floorboard disposed in the midship portion of the hull, the floorboard being configured to fold only at one or more creases oriented in respective athwartships directions;

wherein the foldable floorboard extends across an entire width of a floor of the hull, such that the foldable floorboard is configured to oppose inward collapsing of the midship portion.

12. The collapsible kayak of claim 11, wherein when the kayak is assembled the foldable floorboard is held in place by a multi-use fastener.

13. The collapsible kayak of claim 11, further comprising a pair of side walls disposed in the midship portion, each of the side walls extending downward from a respective gunwale of the hull.

14. The collapsible kayak of claim 13, wherein an upper end of each of the side walls is fixed to the respective gunwale, and a lower end of each of the side walls extends to a selected height above a floor of the hull, forming a gap between the side wall and the hull.

15. The collapsible kayak of claim 14, wherein outboard edges of the floorboard are configured to fit into the respective gaps between the side walls and the floor of the hull.

16. The collapsible kayak of claim 11, wherein an aft edge of the foldable floorboard is configured to be folded upward when the floorboard is installed.

17. The collapsible kayak of claim 11, further comprising a padded seat affixed to an upper surface of the foldable floorboard.

18. The collapsible kayak of claim 11, wherein the bow, stern, and midship portions are configured as a tri-fold, such that the bow portion and the stern portion of the kayak are foldable toward each other and overlap each other at the midship portion when collapsed.

19. The collapsible kayak of claim 11, wherein the hull comprises a closed transom having a V-shaped profile, such that a centerline of the transom is disposed farther forward than outboard edges of the transom.

20. The collapsible kayak of claim 11, wherein the hull further comprises a first pair of flaps configured to overlap and be strapped together to form an aft deck surface over the stern portion of the hull.

* * * * *